US009633489B2

(12) United States Patent
Schmitz et al.

(10) Patent No.: US 9,633,489 B2
(45) Date of Patent: Apr. 25, 2017

(54) CONFIGURABLE ONBOARD INFORMATION PROCESSING

(71) Applicant: The Boeing Company, Chicago, IL (US)

(72) Inventors: Jeffrey Alan Schmitz, St. Charles, MO (US); Eric Lee Nicks, O'Fallon, MO (US); Timothy Joseph Wilmering, Chesterfield, MO (US); Javier Cortez, Glen Carbon, IL (US); Jeanne C. Maggiore, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 10 days.

(21) Appl. No.: 14/482,810

(22) Filed: Sep. 10, 2014

(65) Prior Publication Data

US 2016/0071335 A1 Mar. 10, 2016

(51) Int. Cl.
*G07C 5/08* (2006.01)
*G07C 5/00* (2006.01)

(52) U.S. Cl.
CPC ..... *G07C 5/08* (2013.01); *G07C 5/008* (2013.01)

(58) Field of Classification Search
CPC ..... G05B 23/02; G07C 5/008; G07C 5/0808
USPC ..... 701/29.1, 32.1; 702/185; 703/20
See application file for complete search history.

(56) References Cited

U.S. PATENT DOCUMENTS 5,951,611 A * 9/1999 La Pierre ..... G05B 23/0232 701/32.1
6,208,955 B1 * 3/2001 Provan ..... G06F 11/2257 703/20
6,928,345 B2 * 8/2005 Quinn ..... B60R 16/0234 701/29.1
8,437,904 B2 * 5/2013 Mansouri ..... G07C 5/0808 244/152
2003/0167111 A1 * 9/2003 Kipersztok ..... G05B 23/0278 702/185
2004/0176887 A1 * 9/2004 Kent ..... G07C 5/008 701/29.5
2010/0023201 A1 * 1/2010 Kinney ..... G07C 5/008 701/31.4
2013/0197725 A1 * 8/2013 O'Dell ..... B64F 5/0045 701/14

(Continued)

FOREIGN PATENT DOCUMENTS

EP 2722822 A2 4/2014

OTHER PUBLICATIONS

"Operational Performance: Airplane Health Management," Boeing Management Company, document No. 17893301/2010, copyright 2010, 6 pages.

(Continued)

*Primary Examiner* — Thomas G Black
*Assistant Examiner* — Wae Louie
(74) *Attorney, Agent, or Firm* — Yee & Associates, P.C.

(57) ABSTRACT

A system and method of processing information onboard a vehicle. Execution attributes on the vehicle are read by a computer program running on a data processing system on the vehicle. The execution attributes define a number of information processing actions. The number of information processing actions are performed on the vehicle by the computer program running on the data processing system on the vehicle using the execution attributes.

18 Claims, 8 Drawing Sheets

(56) References Cited

U.S. PATENT DOCUMENTS

2013/0268241 A1* 10/2013 Das ..... G06F 11/00
702/185
2013/0304307 A1* 11/2013 Safa-Bakhsh ..... G07C 5/006
701/31.4

OTHER PUBLICATIONS

"Application Generation Software (AGS)," Teledyne Controls, Apr. 2010, 2 pages.
Extended European Search Report, dated Feb. 12, 2016, regarding Application No. EP15179879.0, 8 pages.

* cited by examiner

CONFIGURABLE ONBOARD INFORMATION PROCESSING

BACKGROUND INFORMATION

1. Field

The present disclosure relates generally to aircraft and other vehicles and, in particular, to processing information onboard an aircraft or other vehicle. Still more particularly, the present disclosure relates to a method and apparatus for processing and reporting operational information on an aircraft or other vehicle by a computer program running on the aircraft or other vehicle and changing the processing and reporting of information onboard the aircraft or other vehicle without changing the computer program.

2. Background

Modern aircraft may comprise many systems. Improper operation of one or more aircraft systems may affect operational performance of an aircraft in undesired ways. For example, improper operation of systems on a commercial passenger aircraft may result in a flight delay, cancellation, air turn back, diversion, or other undesirable flight schedule interruption. Such a schedule interruption may inconvenience customers and cost an airline economically, depending on the aircraft and the nature of the interruption. For military aircraft, improper operation of aircraft systems may reduce mission readiness, result in a mission being aborted, or reduce operational readiness in another undesired way.

Schedule interruptions and other undesired effects on operational readiness may be reduced or eliminated by effective diagnostics and prognostics for aircraft systems. For example, by identifying and predicting improper operation of an aircraft system before it occurs, appropriate preventative or other action may be taken to reduce or eliminate undesired effects on aircraft operations. Providing such diagnostics and prognostics for aircraft systems may be a part of aircraft health management.

The goal of aircraft health management may be to improve the operational performance of an aircraft by turning available aircraft data into useful actionable information. For example, without limitation, an aircraft health management system may be configured to monitor, collect, and analyze available aircraft data to enable engineering and maintenance personnel to make timely, economic, and repeatable maintenance decisions to help improve aircraft operation.

Aircraft health management may be performed using operational information generated by or on an aircraft when the aircraft is in flight. For example, such operational information may include data obtained via direct or indirect connections to a number of data busses on the aircraft. Once acquired, the operational information from an aircraft in flight may be translated, filtered, monitored, and published before being analyzed for aircraft health management.

Current systems and methods for aircraft health management may be improved. For example, it may be desirable to improve the flexibility of current aircraft health management systems so that such systems may be more quickly adapted to take advantage of new sources of aircraft operational information and new ideas about how to use aircraft operational information to improve aircraft health management. Alternatively, or in addition, it may be desirable to improve the efficiency of current aircraft health management systems to provide the benefits of improved aircraft operation more quickly and reliably and at less cost.

Accordingly, it would be beneficial to have a method and apparatus that take into account one or more of the issues discussed above, as well as possibly other issues.

SUMMARY

The illustrative embodiments of the present disclosure provide a method of processing information onboard a vehicle. Execution attributes on the vehicle are read by a computer program running on a data processing system on the vehicle. The execution attributes define a number of information processing actions. The number of information processing actions are performed on the vehicle by the computer program running on the data processing system on the vehicle using the execution attributes.

The illustrative embodiments of the present disclosure also provide an apparatus comprising a computer readable storage media on a vehicle, execution attributes stored on the computer readable storage media on the vehicle, and a computer program comprising program code stored on the computer readable storage media on the vehicle. The execution attributes define a number of information processing actions. The computer program runs on a data processing system on the vehicle to read the execution attributes from the computer readable storage media and to perform the number of information processing actions on the vehicle using the execution attributes.

The illustrative embodiments of the present disclosure also provide a method of processing information onboard a platform. Execution attributes are loaded onto the platform. The execution attributes define a number of information processing actions to be performed by a computer program running on a data processing system on the platform using the execution attributes. The number of information processing actions includes a report action for generating a report defined by the execution attributes. The report generated by the computer program running on the data processing system on the platform using the execution attributes is received from the platform. The report is analyzed to identify a desirable change to information processing onboard the platform. New execution attributes are generated to implement the desirable change to information processing onboard the platform. The new execution attributes define a number of new information processing actions to be performed by the computer program running on the data processing system on the platform using the new execution attributes without changing the computer program on the platform. The new execution attributes are loaded onto the platform.

The features, functions, and benefits can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives, and benefits thereof, will best be understood by reference to the following detailed description of illustrative embodiments of the present disclosure when read in conjunction with the accompanying drawings, wherein:

DETAILED DESCRIPTION

Figure 1:
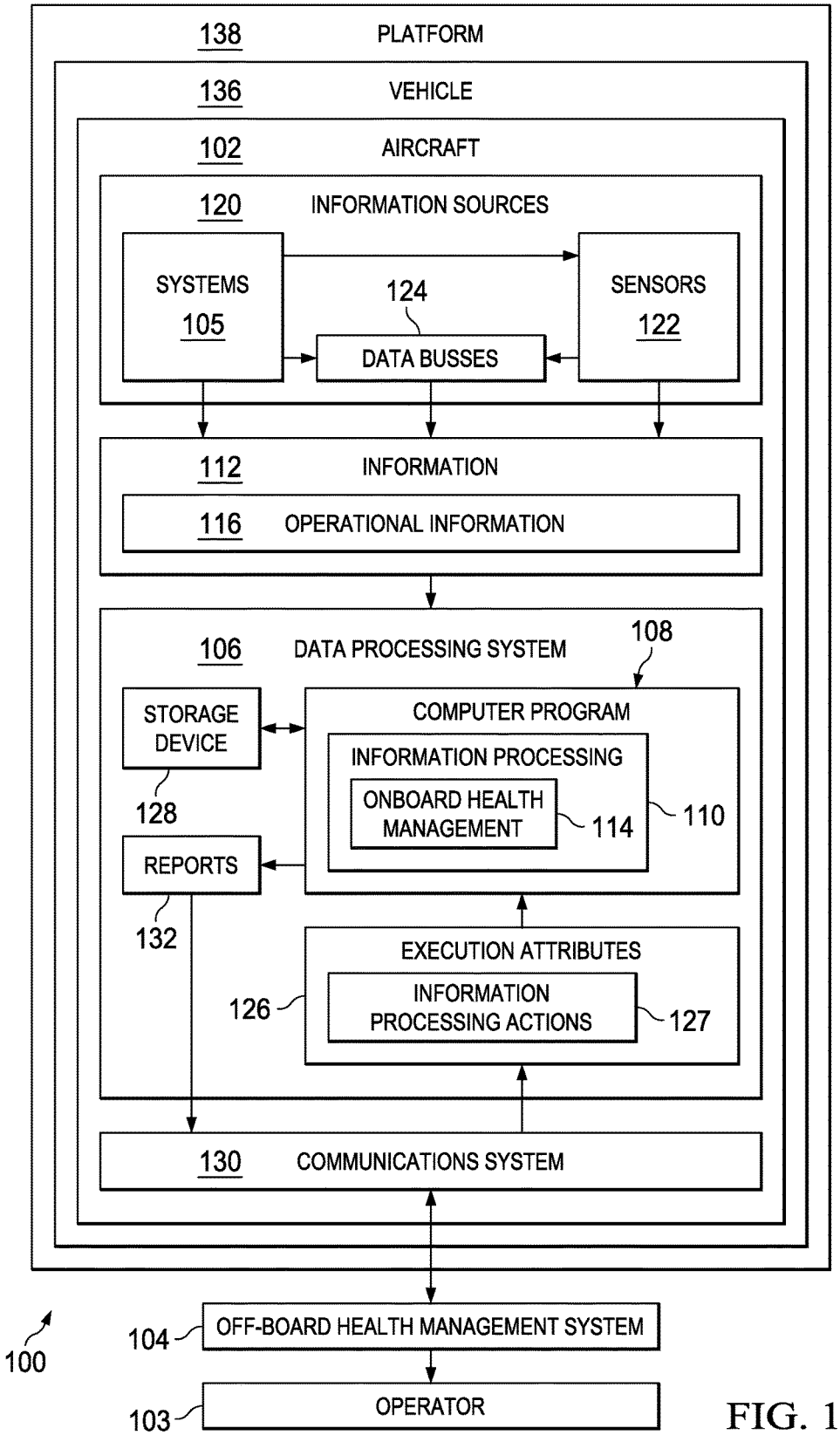
FIG. 1 is an illustration of a block diagram of an aircraft operating environment in accordance with an illustrative embodiment.

The different illustrative embodiments recognize and take into account a number of different considerations. "A number," as used herein with reference to items, means one or more items. For example, "a number of different considerations" are one or more different considerations.

The different illustrative embodiments recognize and take into account that insights gained from the use of aircraft operational information for aircraft health management may lead to new ideas about how to use and manipulate such information to gain further understanding of the aircraft systems being monitored. Implementation of such new ideas may require changes in what aircraft operational information is collected, changes in how aircraft operational information is reported, changes in how aircraft operational information is analyzed, or other changes or various combinations of changes in the processing of aircraft operational information. For example, without limitation, insights gained from the use of aircraft operational information for aircraft health management may indicate that it is desirable to collect different operational information onboard a flying aircraft, that operational information should be collected onboard the aircraft under different circumstances, that the format of reporting the collected information to a location off of the aircraft should be changed, or that other changes or various combinations of changes should be made to processing of the information for aircraft health management.

The different illustrative embodiments also recognize and take into account that newer aircraft data processing systems may have increased access to always available real-time aircraft operational information while an aircraft is in flight. It may be desirable to take advantage of such an increase in the availability of operational information onboard an aircraft for aircraft health management or other appropriate purposes.

Illustrative embodiments also recognize and take into account that currently, the operators of aircraft health management systems may rely on third party avionics suppliers to implement the generation of desirable new operational information for aircraft systems when new operational information that might prove valuable for monitoring and diagnosis of potential issues with aircraft in flight is identified. For example, the implementation of even relatively simple new reports for operational information from an aircraft in flight may require months of work by the operator of an aircraft health management system in specifying the reports, contracting with third parties to implement the changes in computer program code needed to generate the reports, and waiting for the implementation and installation of the changes in computer program code onto a fleet of aircraft.

The different illustrative embodiments recognize and take into account that an aircraft health management system may provide aircraft health management for many aircraft operated by an airline or other aircraft operator. A single commercial airline flight may generate a profusion of operational information that may be useful for aircraft health management. Therefore, a large amount of operational information for many aircraft may need to be translated, filtered, monitored, published, analyzed, or processed in other ways or in various combinations of ways to provide aircraft health management for a fleet of aircraft.

The different illustrative embodiments also recognize and take into account that currently, the onboard processing of operational information for an aircraft in flight may be limited. For example, currently such onboard processing may be limited to capturing raw operational information from aircraft systems during a current flight and reporting the raw operational information to an aircraft health management system on the ground for further processing. There may be limited or no further ability to process the raw operational information captured during a flight onboard the aircraft before the operational information is reported to the aircraft health management system on the ground. Therefore, all or most of the processing of aircraft operational information for aircraft health management may be performed by an off-board aircraft health management system located on the ground. For example, currently an off-board aircraft health management system on the ground may run any and all desired information analysis and reduction algorithms on the potentially vast amount of raw operational information received from a multitude of aircraft.

The different illustrative embodiments recognize and take into account that current limits on onboard processing of aircraft operational information may require sending a relatively large number of reports, reports of relatively large size, or both, from an aircraft in flight to an aircraft health management system on the ground via an appropriate air-to-ground communications system or network. The transmission of large amounts of operational information from an aircraft in flight to a system on the ground via current air-to-ground communications systems and networks may be relatively expensive. Furthermore, the off-board aircraft health management system on the ground may be required to be able to receive, queue up, and eventually process such large amounts of operational information from many aircraft in a fleet.

The different illustrative embodiments recognize and take into account that the large amount of processing of operational information that may be performed by an off-board aircraft health management system may result in report queue and data analysis bottlenecks at the ground system. As a result, operational information received from an aircraft in flight may need to wait an inordinate amount of time before being processed by an off-board aircraft health management system. In this case, the ability of the aircraft health management system to provide effective real-time monitoring of aircraft health may be reduced.

Illustrative embodiments provide a method and apparatus for processing information onboard an aircraft or other vehicle that is configurable and adaptable. For example, without limitation, illustrative embodiments may be used to process operational information onboard an aircraft or other vehicle to provide health management for the aircraft or other vehicle or for another appropriate purpose or various combinations of purposes.

In accordance with an illustrative embodiment, information processing actions to be performed on an aircraft or other vehicle may be defined by execution attributes. The execution attributes may be loaded on an aircraft or other vehicle and read by a computer program running on a data processing system on the aircraft or other vehicle. The computer program running on the aircraft or other vehicle may then perform the information processing actions onboard the aircraft or other vehicle as defined by the execution attributes.

Although the execution attributes define how the computer program running on the aircraft or other vehicle processes information onboard the aircraft or other vehicle, the execution attributes are not a part of the computer program itself. Therefore, information processing onboard the aircraft or other vehicle may be changed by changing the execution attributes without changing the computer program on the aircraft or other vehicle. In accordance with an illustrative embodiment, the execution attributes may be easily specified to define information processing actions to be performed on an aircraft or other vehicle and may be changed easily to change the information processing actions performed on the aircraft or other vehicle. In contrast, changing the program code for a computer program implemented on an aircraft or other vehicle may be more complex and may require more time and expense to implement, test, and install on the aircraft or other vehicle.

In accordance with an illustrative embodiment, execution attributes may identify information to be processed and operations to be performed on the information to define various information processing actions. For example, without limitation, the execution attributes may be specified using various information identifiers and operation identifiers used as building-blocks that are combined to form a number of execution stacks in reverse Polish notation or in another appropriate manner. An infinite number of simple to complex information processing actions may be specified using information identifiers and operation identifiers to form execution stacks in this manner. For example, without limitation, information processing actions that implement algorithms for identifying trigger conditions, saving operational data onboard the aircraft or other vehicle, data reduction, fault analysis, report generation, other algorithms, or various combinations of algorithms may be defined by execution attributes comprising execution stacks in accordance with an illustrative embodiment. Information processing actions defined by the execution stacks may reference and build on each other to define information analysis or other information processing to be performed onboard an aircraft or other vehicle.

Illustrative embodiments may streamline the implementation of desired changes to information processing performed on an aircraft or other vehicle for vehicle health management or other appropriate purposes. For example, without limitation, illustrative embodiments may provide a much faster feedback loop between off-board data analysis of operational information from an aircraft or other vehicle, development of new algorithms based on insights gained from the off-board analysis, and the implementation of changes to operational information capture, analysis, and reporting onboard the aircraft or other vehicle to implement the new algorithms. Therefore, for example, illustrative embodiments may allow new health management algorithms and the resulting insights gained from their implementation to build on each other more quickly, thereby increasing the pace of implementation of improvements in health management for aircraft or other vehicles.

Illustrative embodiments provide the ability to configure and run higher order processing of operational and other information onboard an aircraft or other vehicle for vehicle health management or other appropriate purposes. For example, without limitation, illustrative embodiments may allow an aircraft health management system at a location on the ground and off of an aircraft to configure information processing onboard an aircraft to perform relatively higher order information analysis for the purpose of health monitoring and fault identification onboard the aircraft. For example, without limitation, illustrative embodiments may be used to implement new and more powerful algorithms to run onboard an aircraft to take advantage of the increased availability of real-time operational information onboard newer aircraft for aircraft health management or other appropriate purposes.

Illustrative embodiments provide for configuring a computer program running on an aircraft or other vehicle to perform information processing for health management that may currently be performed at a ground location off of the aircraft. Therefore, illustrative embodiments may reduce the amount of data that is sent from an aircraft to ground systems for aircraft health management. In particular, illustrative embodiments may reduce the amount of data sent from an aircraft in flight to an aircraft health management system on the ground over relatively expensive air-to-ground communications systems. Illustrative embodiments also may reduce report queue and data analysis bottlenecks that currently may occur at aircraft health management systems located on the ground and off of the aircraft. Therefore, illustrative embodiments may allow more powerful information analyses to be performed in a more timely manner, more frequently, or both.

Turning to FIG. 1, an illustration of a block diagram of an aircraft operating environment is depicted in accordance with an illustrative embodiment. Aircraft operating environment 100 may include any appropriate environment in which aircraft 102 may be operated to perform any appropriate mission or task.

Aircraft 102 may include any appropriate type of aircraft. For example, without limitation, aircraft 102 may comprise a commercial passenger aircraft, a cargo aircraft, a private or personal aviation aircraft, a military aircraft, or any other appropriate type of aircraft that may be used for any appropriate purpose. Aircraft 102 may be a fixed-wing, rotary-wing, or lighter-than-air aircraft. Aircraft 102 may be a manned or unmanned aircraft.

Aircraft 102 may be operated by operator 103. Operator 103 may include any appropriate entity for operating aircraft 102 in aircraft operating environment 100. For example, without limitation, operator 103 may comprise an airline, a military unit, or any other appropriate private or government entity.

Operator 103 may use off-board health management system 104 to manage the health of aircraft 102. Off-board health management system 104 may be operated by or for operator 103 to improve the operational performance of aircraft 102 by turning available aircraft data into useful actionable information. For example, without limitation, off-board health management system 104 may be configured to monitor, collect, and analyze available aircraft data to enable engineering and maintenance personnel to make timely, economic, and repeatable maintenance decisions to help improve the operation of aircraft 102. Off-board health management system 104 may be implemented in an appropriate data processing system located off of aircraft 102.

Aircraft 102 may comprise a number of systems 105 for performing various functions on aircraft 102. For example, without limitation, systems 105 on aircraft 102 may include power systems, engine systems, avionics systems, navigations systems, communications systems, environmental systems, other systems, or various combinations of systems for performing various appropriate functions on aircraft 102.

Systems 105 on aircraft 102 may include data processing system 106. Data processing system 106 may comprise any appropriate computer system or other system or device for running computer programs on aircraft 102. For example, without limitation, data processing system 106 may comprise an aircraft network data processing system on aircraft 102.

Computer program 108 may comprise program code that is loaded on aircraft 102 and configured to run on data processing system 106 on aircraft 102. Computer program 108 may be implemented in any appropriate manner and using any appropriate programming language to perform the functions of computer program 108 as described herein.

In accordance with an illustrative embodiment, computer program 108 is configured to run on data processing system 106 to perform information processing 110 onboard aircraft 102. Information processing 110 may include processing information 112 onboard aircraft 102 in any appropriate manner. For example, without limitation, information processing 110 may include processing information 112 in an appropriate manner to provide onboard health management 114 for aircraft 102. Onboard health management 114 may be used by or in combination with off-board health management system 104 to improve health management for aircraft 102.

Information 112 processed onboard aircraft 102 may include any appropriate information on aircraft 102. Information 112 may be provided on aircraft 102 in any appropriate manner and form for processing by computer program 108 running on data processing system 106 on aircraft 102.

For example, without limitation, information 112 may include operational information 116. Operational information 116 may include any appropriate information that may be generated by or on aircraft 102 when aircraft 102 is in operation. For example, without limitation, operational information 116 may include information 112 that is generated by or on aircraft 102 when aircraft 102 is in flight.

Operational information 116 may indicate a state or condition of aircraft 102 or of a number of systems 105 on aircraft 102 when aircraft 102 is in operation. For example, without limitation, operational information 116 may indicate the altitude of aircraft 102, the speed of aircraft 102, positions of various flight control surfaces on aircraft 102, fuel usage by aircraft 102, another state or condition of aircraft 102 or of systems 105 on aircraft 102, or various combinations of states or conditions of aircraft 102, of systems 105 on aircraft 102, or both.

Information 112 may be provided to data processing system 106 or retrieved by data processing system 106 for information processing 110 onboard aircraft 102 from a number of information sources 120 on aircraft 102. For example, without limitation, information sources 120 may include systems 105, sensors 122, and data busses 124.

For example, without limitation, a number of systems 105 on aircraft 102 may be configured to provide operational information 116 identifying the state or condition of systems 105 when aircraft 102 is in operation. Alternatively, or in addition, various appropriate sensors 122 on aircraft 102 may be configured to provide operational information 116 identifying the state or condition of aircraft 102, of various systems 105 on aircraft 102, or both, when aircraft 102 is in operation. Sensors 122 may include appropriate wired sensors, wireless sensors, or both wired sensors and wireless sensors. For example, without limitation, sensors 122 may comprise a wired sensor network on aircraft 102, a wireless sensor network on aircraft 102, or both.

Information 112 from systems 105 on aircraft 102 may be provided directly to data processing system 106 for information processing 110 via any appropriate connections between systems 105 and data processing system 106. Information 112 from sensors 122 on aircraft 102 may be provided directly to data processing system 106 for information processing 110 via any appropriate connections between sensors 122 and data processing system 106. Appropriate connections between and among systems 105, sensors 122, and data processing system 106 on aircraft 102 may include wired connections, wireless connections, optical connections, or any other appropriate connections or combination of connections.

Alternatively, or in addition, information 112 may be provided from systems 105, sensors 122, or both systems 105 and sensors 122, on a number of data busses 124 on aircraft 102. In this case, data processing system 106 may be connected to data busses 124 in an appropriate manner such that information 112 for information processing 110 by computer program 108 running on data processing system 106 may be obtained from number of data busses 124 by data processing system 106. Data busses 124 on aircraft 102 may be implemented in any appropriate manner.

In accordance with an illustrative embodiment, information processing 110 onboard aircraft 102 may be defined by execution attributes 126. Execution attributes 126 may define various information processing actions 127. Information processing actions 127 may include any appropriate actions to be performed on or using information 112 on aircraft 102 by computer program 108 running on data processing system 106 on aircraft 102. For example, without limitation, information processing actions 127 may include one or more of identifying, receiving, analyzing, changing, storing, or reporting information 112 on aircraft 102. Execution attributes 126 may identify information 112 on aircraft 102 to be used to perform information processing actions 127 onboard aircraft 102 and operations to be performed on information 112 to perform information processing actions 127 onboard aircraft 102. For example, without limitation, execution attributes 126 may define various information processing actions 127 for performing onboard health management 114 or for any other appropriate purpose.

Execution attributes 126 may be provided in any appropriate form for use on aircraft 102. For example, execution attributes 126 may comprise execution stacks, wherein a sequence for processing execution attributes 126 by computer program 108 running on data processing system 106 on aircraft 102 may be defined by the order of execution attributes 126 in the execution stacks. For example, without limitation, the order of execution attributes 126 in the execution stacks may define the sequence for processing execution attributes 126 in reverse Polish notation.

For example, without limitation, execution attributes 126 may be provided in a text file or in another appropriate computer readable file format that is loaded and stored on aircraft 102. For example, execution attributes 126 may be stored in storage device 128 on aircraft 102.

Storage device 128 may include any appropriate computer readable storage media for storing execution attributes 126 and other appropriate information on aircraft 102. Storage device 128 may be part of data processing system 106 or separate from data processing system 106 but accessible by data processing system 106 running computer program 108 on aircraft 102.

Execution attributes 126 may be sent to aircraft 102 for storing in storage device 128 on aircraft 102 via communications system 130. Communications system 130 may include any appropriate communications system for receiving information by aircraft 102 from a location off of aircraft 102 and for sending information from aircraft 102 to a location off of aircraft 102 via any appropriate communications media and using any appropriate communications protocol. For example, communications system 130 may include a system for receiving information by aircraft 102 from a location on the ground and for sending information from aircraft 102 to a location on the ground while aircraft 102 is in flight. For example, without limitation, communications system 130 may include the Aircraft Communications Addressing and Reporting System, ACARS. This system is a digital datalink system for transmission of messages between aircraft and ground stations via airband radio or satellite.

Computer program 108 running on data processing system 106 on aircraft 102 may read execution attributes 126 from storage device 128 and then perform information processing 110 onboard aircraft 102 using execution attributes 126 by performing information processing actions 127 as defined by execution attributes 126. Alternatively, or in addition, computer program 108 running on data processing system 106 may be configured to read execution attributes 126 from a computer readable signal that is received on aircraft 102 via communications system 130 without storing execution attributes in storage device 128 on aircraft 102.

For example, without limitation, information processing actions 127 defined by execution attributes 126 may include a persist action. A persist action may include collecting information 112 onboard aircraft 102 during a flight and storing the collected information 112 onboard aircraft 102 for later use. For example, information 112 identified by execution attributes 126 may be collected by computer program 108 running on data processing system 106 during a flight and may be stored in storage device 128 on aircraft 102 or in another appropriate location for later use. Information 112 for a flight of aircraft 102 may be processed by computer program 108 running on data processing system 106 in a manner defined by execution attributes 126 before being stored in storage device 128 on aircraft 102.

For example, without limitation, information processing actions 127 defined by execution attributes 126 may include a report action. A report action may include generating reports 132. In this case, execution attributes 126 may identify information 112 to be included in reports 132 and the format of reports 132 to be generated by computer program 108 running on data processing system 106 on aircraft 102 using execution attributes 126.

Reports 132 generated by computer program 108 running on data processing system 106 on aircraft 102 may be sent to off-board health management system 104 or to another appropriate location off of aircraft 102 via communications system 130. For example, without limitation, reports 132 may be sent from aircraft 102 to off-board health management system 104 or to another appropriate location on the ground via communications system 130 when aircraft 102 is in flight. Off-board health management system 104 may be configured to analyze reports 132 received from aircraft 102 to identify the health of aircraft 102 and to provide appropriate notifications to aircraft operator 103 regarding the health of aircraft 102.

Analysis of reports 132 generated by computer program 108 running on aircraft 102, by off-board health management system 104 or another entity, may indicate that it may be desirable to change information processing 110 onboard aircraft 102. For example, without limitation, it may be desirable to change information processing 110 on aircraft 102 to improve the usefulness or other characteristics of reports 132 generated on aircraft 102 to improve aircraft health management or for other appropriate reasons. In this case, off-board health management system 104 or another appropriate entity may generate new execution attributes 126 that define the desired improved information processing 110 to be performed on aircraft 102. For example, new execution attributes 126 may define new information processing actions 127 to be performed on aircraft 102.

New execution attributes 126 may be in addition to execution attributes 126 already on aircraft 102 or may replace some or all of execution attributes 126 currently used on aircraft 102. New execution attributes 126 may be loaded on aircraft 102 by adding the new execution attributes 126 to execution attributes 126 already on aircraft 102, by modifying execution attributes 126 already loaded on aircraft 102, or both. Alternatively, new execution attributes may be loaded on aircraft 102 by replacing all of execution attributes 126 on aircraft 102 with execution attributes 126 including the new execution attributes 126. For example, without limitation, new execution attributes 126 may be delivered to aircraft 102 via communications system 130 or in another appropriate manner, while aircraft 102 is on the ground or in flight, to change information processing 110 onboard aircraft 102 as desired.

Although execution attributes 126 define how computer program 108 running on data processing system 106 on aircraft 102 performs information processing 110 onboard aircraft 102, execution attributes 126 do not include program code for computer program 108 and thus are not a part of computer program 108. Therefore, information processing 110 onboard aircraft 102 by computer program 108 running on data processing system 106 on aircraft 102 may be changed as desired by changing execution attributes 126 on aircraft 102 without changing any of the program code for computer program 108.

Aircraft 102 is an example of vehicle 136. Illustrative embodiments may be used for configurable onboard information processing on vehicle 136 other than aircraft 102. Vehicle 136 may comprise any vehicle configured for operation in the air, in space, on land, on water, under water, or in any other medium or combinations of media.

Vehicle 136 is an example of platform 138. Illustrative embodiments may be used for configurable onboard information processing on platform 138 other than vehicle 136. For example, without limitation, platform 138 may be a building, an oil rig, a manufacturing facility, a mine, or any other appropriate fixed or mobile platform.

The illustration of FIG. 1 is not meant to imply physical or architectural limitations to the manner in which different illustrative embodiments may be implemented. Other components in addition to, in place of, or both in addition to and in place of the ones illustrated may be used. Some components may be unnecessary in some illustrative embodiments. Also, the blocks are presented to illustrate some functional components. One or more of these blocks may be combined or divided into different blocks when implemented in different illustrative embodiments.

Figure 2:
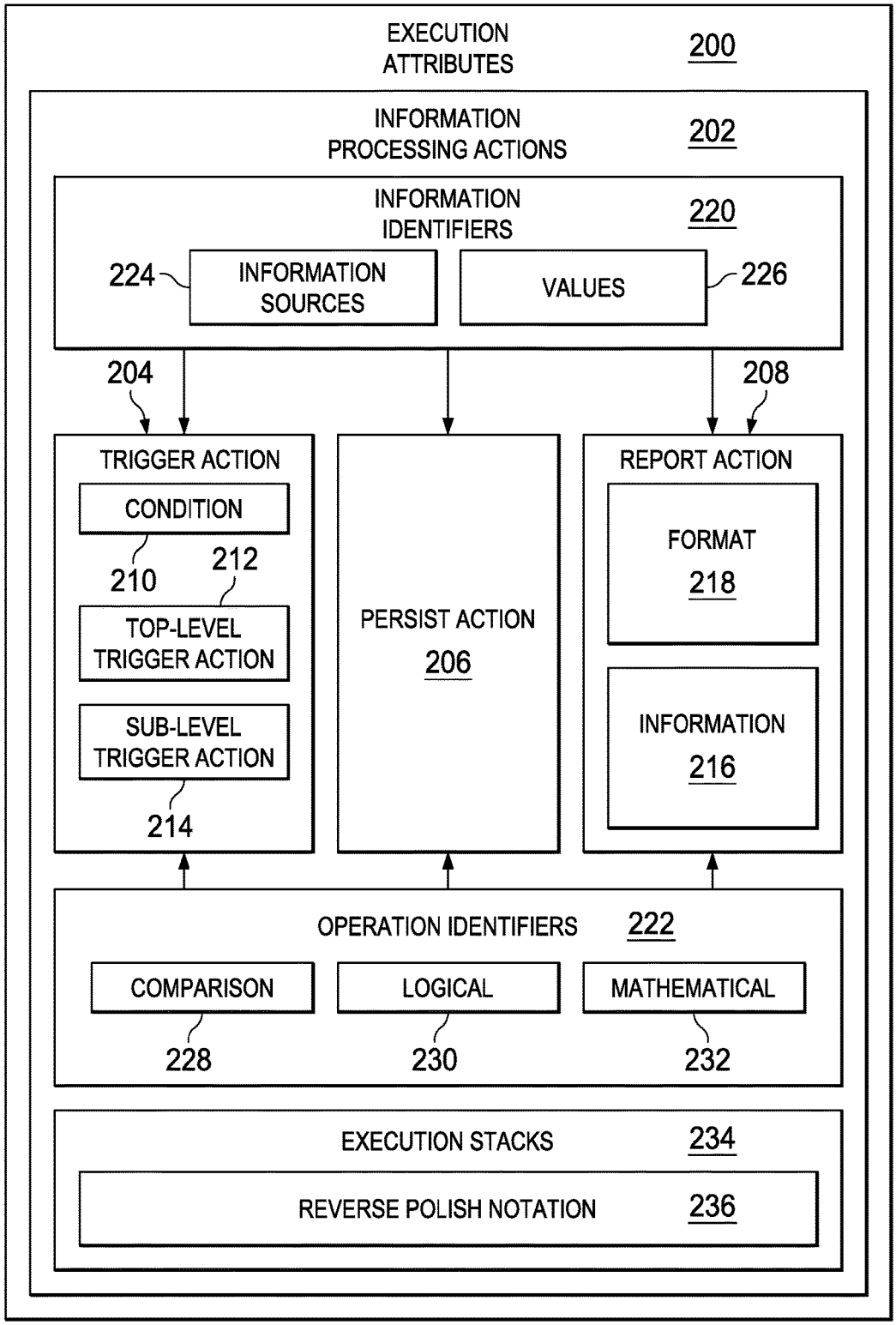
FIG. 2 is an illustration of a block diagram of execution attributes for onboard information processing in accordance with an illustrative embodiment.

Turning to FIG. 2, an illustration of a block diagram of execution attributes for onboard information processing is depicted in accordance with an illustrative embodiment. Execution attributes 200 may be an example of one implementation of execution attributes 126 in FIG. 1.

Execution attributes 200 may define various information processing actions 202 to be performed by a computer program on an aircraft or other vehicle. For example, without limitation, information processing actions 202 that may be defined by execution attributes 200 may include trigger action 204, persist action 206, report action 208, another appropriate information processing action, or various combinations of information processing actions.

Trigger action 204 defines condition 210 to be satisfied as well as other information processing actions 202 to be invoked in response to a determination that condition 210 is satisfied. Trigger action 204 may comprise top-level trigger action 212 or sub-level trigger action 214. Top-level trigger action 212 is performed automatically to determine whether condition 210 for top-level trigger action 212 is satisfied before other information processing actions 202 associated with top-level trigger action 212 are performed. For example, without limitation, top-level trigger action 212 may be performed automatically on a periodic or other appropriate basis until condition 210 for top-level trigger action 212 is determined to be satisfied. Other information processing actions 202 associated with top-level trigger action 212 may be performed only in response to a determination that condition 210 for top-level trigger action 212 is satisfied. Sub-level trigger action 214 may be one of information processing actions 202 associated with top-level trigger action 212 that is performed in response to a determination that condition 210 for top-level trigger action 212 is satisfied.

Persist action 206 defines information that is to be collected and saved onboard an aircraft or other vehicle for later use on the aircraft or other vehicle. For example, without limitation, persist action 206 may identify aircraft operational information for a flight of the aircraft that is to be collected and saved onboard the aircraft for later use on the aircraft after the flight is completed. For example, without limitation, operational information for a plurality of flights that is saved onboard an aircraft by persist action 206 may be used to perform analysis on the aircraft for any appropriate purpose.

Report action 208 defines generating a report. For example, without limitation, report action 208 may be defined by information 216 to be included in the report and format 218 for the report.

Execution attributes 200 may include information identifiers 220 and operation identifiers 222. Information identifiers 220 and operation identifiers 222 may be used as building blocks to define information processing actions 202.

Information identifiers 220 identify information to be processed to perform information processing actions 202. For example, without limitation, information identifiers 220 may identify information to be processed by identifying information sources 224 for the information to be processed. Alternatively, or in addition, information identifiers 220 may indicate values 226 to be used to perform information processing actions 202.

Operation identifiers 222 identify operations to be performed on or using information to perform information processing actions 202. For example, without limitation, operation identifiers 222 may identify comparison 228 to be made between information, logical 230 or mathematical 232 operations to be performed on or using information, or any other appropriate operation or various combinations of operations to be performed on or using information to perform information processing actions 202.

In accordance with an illustrative embodiment, execution attributes 200 may be combined to form execution stacks 234 defining information processing actions 202. The order of execution attributes 200 in execution stacks 234 may define the sequence in which execution attributes 200 are processed by a computer program running on a data processing system to perform information processing actions 202 defined by execution attributes 200.

Without limitation, the order of execution attributes 200 in execution stacks 234 may define the sequence for processing execution attributes 200 to perform information processing actions 202 in reverse Polish notation 236. In execution stacks 234 using reverse Polish notation 236, operation identifiers 222 follow information identifiers 220 identifying the information on which the operations identified by operation identifiers 222 are to be performed.

Figure 3:
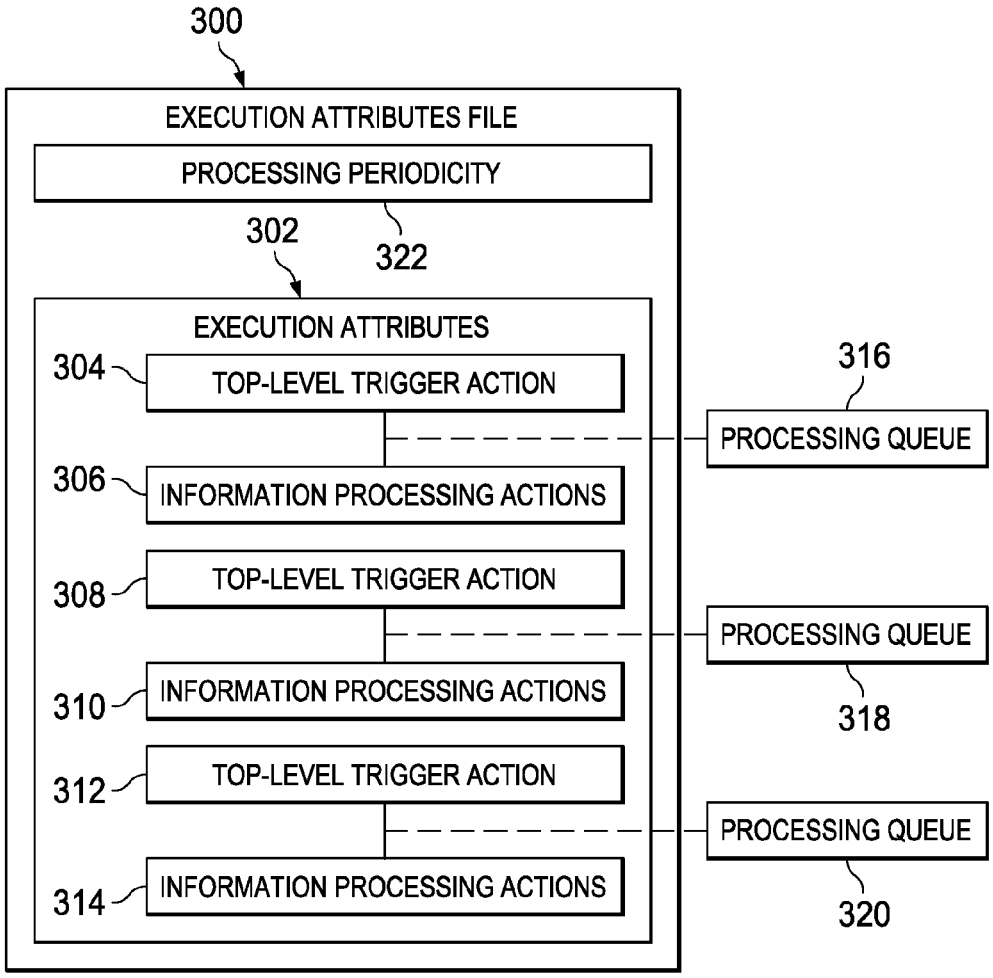
FIG. 3 is an illustration of a block diagram of an execution attributes file in accordance with an illustrative embodiment.

Turning to FIG. 3, an illustration of a block diagram of an execution attributes file is depicted in accordance with an illustrative embodiment. Execution attributes file 300 may be an example of one implementation of a document comprising execution attributes 126 in FIG. 1 or execution attributes 200 in FIG. 2.

Execution attributes file 300 may be referred to as a file or document comprising execution attributes 302. Execution attributes file 300 may comprise execution attributes 302 in a format that is readable both by a human and a computer. For example, without limitation, execution attributes file 300 may comprise execution attributes 302 that are encoded using extensible markup language, XML, or in another appropriate manner.

In this example, execution attributes 302 define top-level trigger action 304 and information processing actions 306 associated with top-level trigger action 304, top-level trigger action 308 and information processing actions 310 associated with top-level trigger action 308, and top-level trigger action 312 and information processing actions 314 associated with top-level trigger action 312. An execution attributes file in accordance with an illustrative embodiment may include execution attributes 302 defining more or fewer than three top-level trigger actions and associated information processing actions.

Execution attributes 302 for each top-level trigger action 304, 308, and 312 define a condition. Information processing actions 306, 310, and 314 associated with each top-level trigger action 304, 308, and 312, respectively, are performed in response to a determination that the condition for the corresponding top-level trigger action 304, 308, or 312 is satisfied.

During processing, such as by a computer program on an aircraft or other vehicle, execution attributes 302 for top-level trigger actions 304, 308, and 312, may be placed along with execution attributes 302 for corresponding information processing actions 306, 310, and 314, in separate processing queues 316, 318, and 320, respectively. Top-level trigger actions 304, 308, and 312, in each of processing queues 316, 318, and 320, may be processed automatically in-turn to determine whether the conditions defined by top-level trigger actions 304, 308, and 312, are satisfied. When the condition defined by one of top-level trigger actions 304, 308, or 312, is determined to be satisfied, execution attributes 302 for corresponding information processing actions 306, 310, or 314, may be processed.

Processing periodicity 322 may be identified in execution attributes file 300. Processing periodicity 322 may indicate how often each top-level trigger action 304, 308, and 312, in each of processing queues 316, 318, and 320, is processed to determine whether the conditions defined by top-level trigger actions 304, 308, and 312, are satisfied. Processing periodicity 322 may be the same for each top-level trigger action 304, 308, and 312, defined in execution attributes file 300. Alternatively, processing periodicity 322 may be defined separately for each top-level trigger action 304, 308, and 312, defined in execution attributes file 300.

Figure 4:
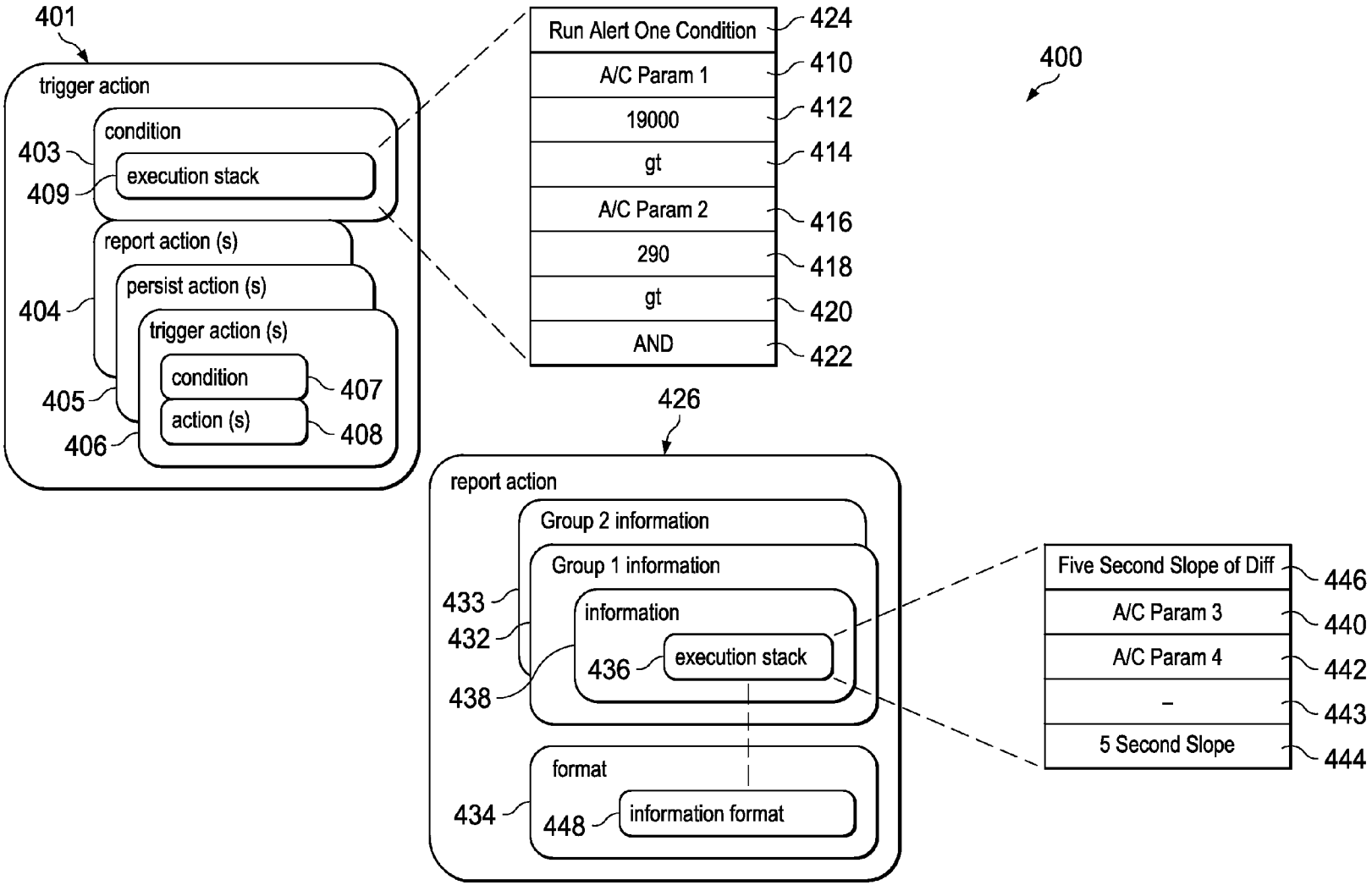
FIG. 4 is an illustration of execution attributes defining information processing actions for information processing onboard an aircraft in accordance with an illustrative embodiment.

Turning to FIG. 4, an illustration of execution attributes defining information processing actions for information processing onboard an aircraft is depicted in accordance with an illustrative embodiment. Execution attributes 400 may be an example of one implementation of execution attributes 126 defining information processing actions 127 for onboard health management 114 in FIG. 1.

Execution attributes 400 define trigger action 401. In this case, trigger action 401 may be a top-level trigger action. Execution attributes 400 define condition 403 for trigger action 401 as well as other information processing actions to be performed in response to a determination that condition 403 is satisfied. In this case, information processing actions to be performed in response to a determination that condition 403 for trigger action 401 is satisfied include report actions 404, persist actions 405, and trigger actions 406. In this case, trigger actions 406 are sub-level trigger actions. Each of trigger actions 406 may be defined by its own condition 407 as well as information processing actions 408 to be performed in response to a determination that condition 407 is satisfied.

Execution attributes 400 are combined to form execution stack 409 defining condition 403 for trigger action 401. In this example, execution attributes 410, 412, 414, 416, 418, 420, and 422 in execution stack 409 define Run Alert One Condition 424 using reverse Polish notation. Execution attributes 410 and 416 are information identifiers in which information is identified by indicating sources of the information. In this case, execution attributes 410 and 416 are information identifiers that identify sources of information for Aircraft Parameter 1 and Aircraft Parameter 2, respectively. Execution attributes 412 and 418 are information identifiers in which information is identified by indicating specific values. Execution attributes 414 and 420 are operation identifiers in which comparison operations are identified. Execution attribute 422 is an operation identifier in which a logical operation is identified. In this example, Run Alert One Condition 424 is determined to be satisfied when both Aircraft Parameter 1 is greater than 19000 and Aircraft Parameter 2 is greater than 290.

Execution attributes 400 also define report action 426. Execution attributes 400 define Group 1 information 432 and Group 2 information 433 to be included in a report generated by performing report action 426 as well as format 434 for the report.

Execution attributes 400 are combined to form execution stack 436 defining information 438 from Group 1 information 432 to be included in the report. In this example, execution attributes 440, 442, 443, and 444, in execution stack 436 define Five Second Slope of Difference information 446 to be included in the report using reverse Polish notation. Execution attributes 440 and 442 are information identifiers in which information is identified by indicating sources of information. In this case, execution attributes 440 and 442 are information identifiers that identify sources of information for Aircraft Parameter 3 and Aircraft Parameter 4, respectively. Execution attributes 443 and 444 are operation identifiers in which mathematical operations are identified. In this example, Five Second Slope of Difference information 446 to be included in the report is calculated by determining the difference between Aircraft Parameter 3 and Aircraft Parameter 4 and determining the slope of that difference over five seconds. The format for providing Five Second Slope of Difference information 446 in the report may be defined by execution attributes 400 defining information format 448 for Five Second Slope of Difference information 446 in execution attributes 400 defining format 434 for the report.

Figure 5:
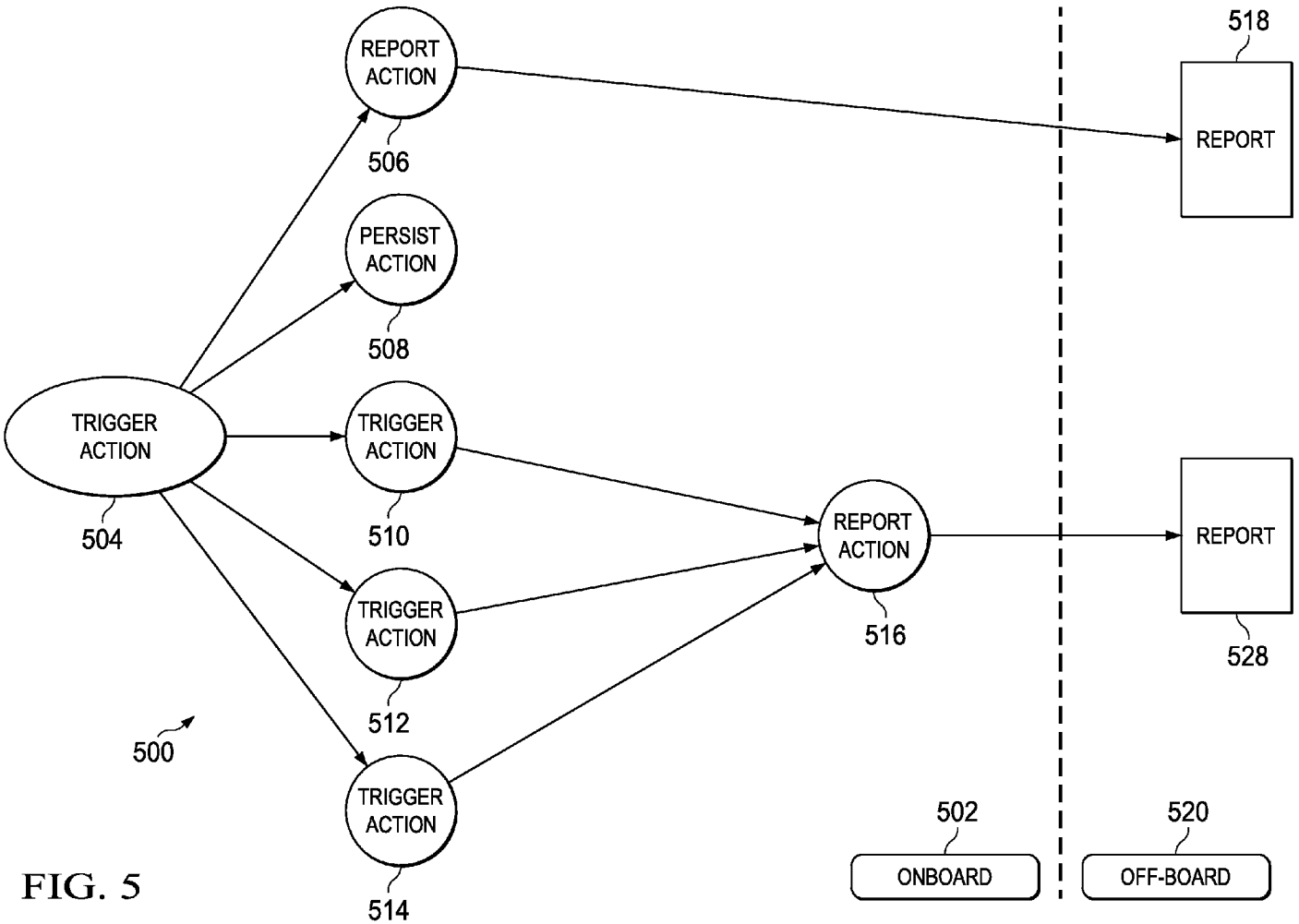
FIG. 5 is an illustration of onboard information processing in accordance with an illustrative embodiment.

Turning to FIG. 5, an illustration of onboard information processing is depicted in accordance with an illustrative embodiment. Information processing 500 may be an example of one implementation of information processing 110 onboard aircraft 102 in FIG. 1.

Information processing 500 onboard 502 an aircraft or other vehicle is defined by a number of information processing actions. The information processing actions are defined by execution attributes onboard 502 the aircraft or other vehicle. The information processing actions may be performed onboard 502 the aircraft or other vehicle by a computer program running on a data processing system onboard 502 the aircraft or other vehicle using the execution attributes. In this example, information processing actions defined by execution attributes for information processing 500 onboard 502 an aircraft or other vehicle include trigger action 504, report action 506, persist action 508, trigger actions 510, 512, and 514, and report action 516.

Trigger action 504 is a top-level trigger action. Execution attributes define a condition for trigger action 504. Trigger action 504 may be performed automatically and repeatedly, on an appropriate periodic or other basis, until the condition for trigger action 504 is determined to be satisfied. Report action 506, persist action 508, and trigger actions 510, 512, and 514, are performed in response to a determination that the condition for trigger action 504 is satisfied.

Report action 506 is performed to generate report 518. Execution attributes may define the information to be included in report 518 and the format of report 518 generated by report action 506. Report 518 may be sent to an appropriate location off-board 520 the aircraft or other vehicle for analysis or any other appropriate purpose or combination of purposes.

Persist action 508 is performed to save information onboard 502 an aircraft or other vehicle for later use. Execution attributes may define the information that is to be collected and saved onboard 502 by persist action 508. Persist action 508 may include processing collected information, in a manner defined by execution attributes, and saving the processed information onboard 502 the aircraft or other vehicle.

Trigger actions 510, 512, and 514 are sub-level trigger actions. Each of trigger actions 510, 512, and 514 may be defined by its own condition. In this example, report action 516 is performed in response to a determination that all of the conditions for trigger actions 510, 512, and 514 are satisfied.

Report action 516 is performed to generate report 528. Execution attributes may define the information to be included in report 528 and the format of report 528 generated by report action 516. Report 528 may be sent to an appropriate location off-board 520 the aircraft or other vehicle for analysis or any other appropriate purpose or combination of purposes.

Figure 6:
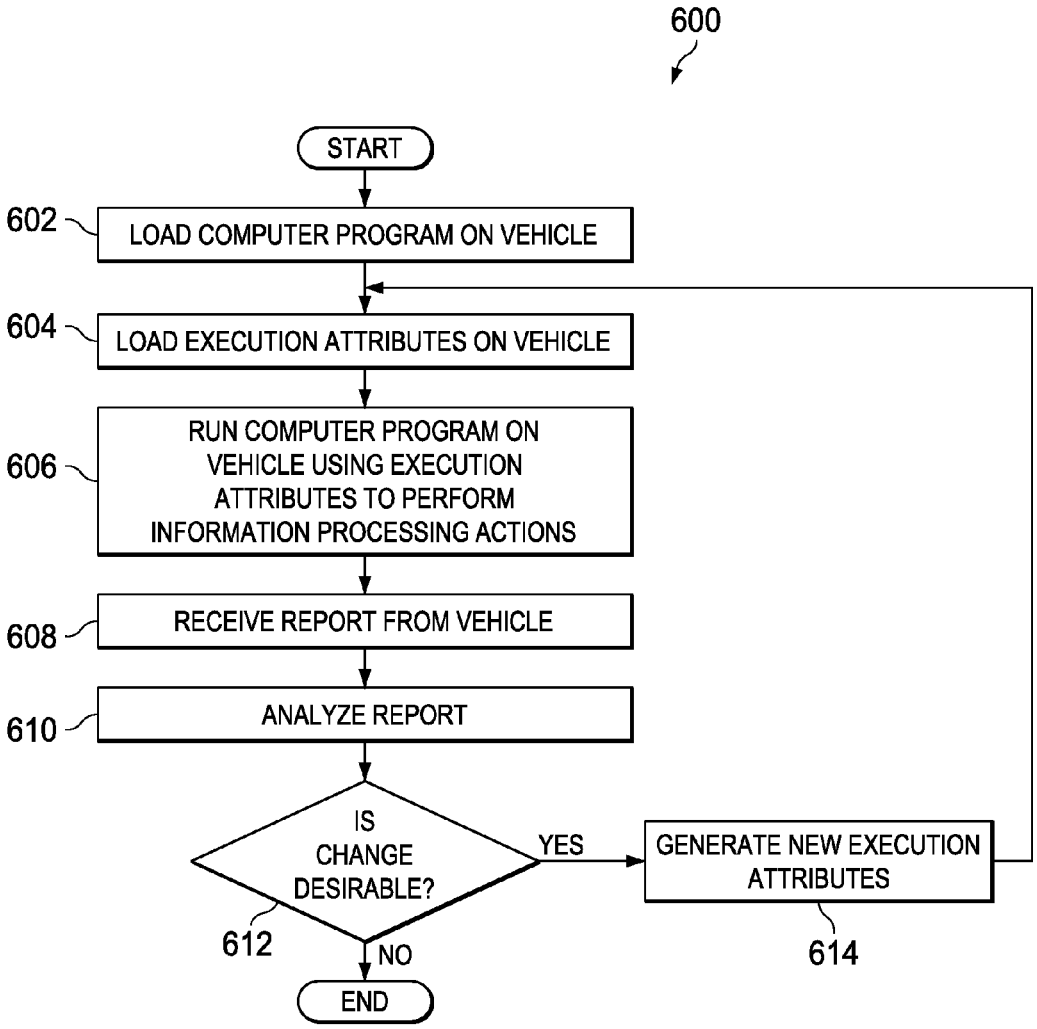
FIG. 6 is an illustration of a flowchart of a process for information processing in accordance with an illustrative embodiment.

Turning to FIG. 6, an illustration of a flowchart of a process for information processing is depicted in accordance with an illustrative embodiment. For example, process 600 may be implemented in aircraft operating environment 100 to provide health management for aircraft 102 in FIG. 1.

Process 600 may begin with loading a computer program on a vehicle (operation 602). The computer program may be configured to run on a data processing system on the vehicle to perform information processing. Execution attributes also may be loaded on the vehicle (operation 604). The execution attributes may define information processing actions to be performed onboard the vehicle by the computer program running on the data processing system on the vehicle. The computer program then may be run on the vehicle using the execution attributes to perform the information processing actions onboard the vehicle (operation 606). The information processing actions performed on the vehicle may include generating a report and sending the report off of the vehicle.

The report generated onboard the vehicle may be received (operation 608) and analyzed (operation 610). Operations 608 and 610 may be performed at a location off-board the vehicle. Based on the analysis performed in operation 610, it may be determined whether a change is desirable (operation 612). For example, the analysis may indicate that a change to the information processing performed on the vehicle is desirable. In response to a determination at operation 612 that a change is desirable, new execution attributes may be generated (operation 614). The new execution attributes may be configured to implement the desired change in information processing onboard the vehicle. Process 600 then may return to operation 604 where the new execution attributes may be loaded on the vehicle to replace the execution attributes currently loaded on the vehicle. Thereby, information processing onboard the vehicle may be changed without changing the program code for the computer program loaded on the vehicle. Process 600 may terminate in response to a determination at operation 612 that a change is not desirable.

Figure 7:
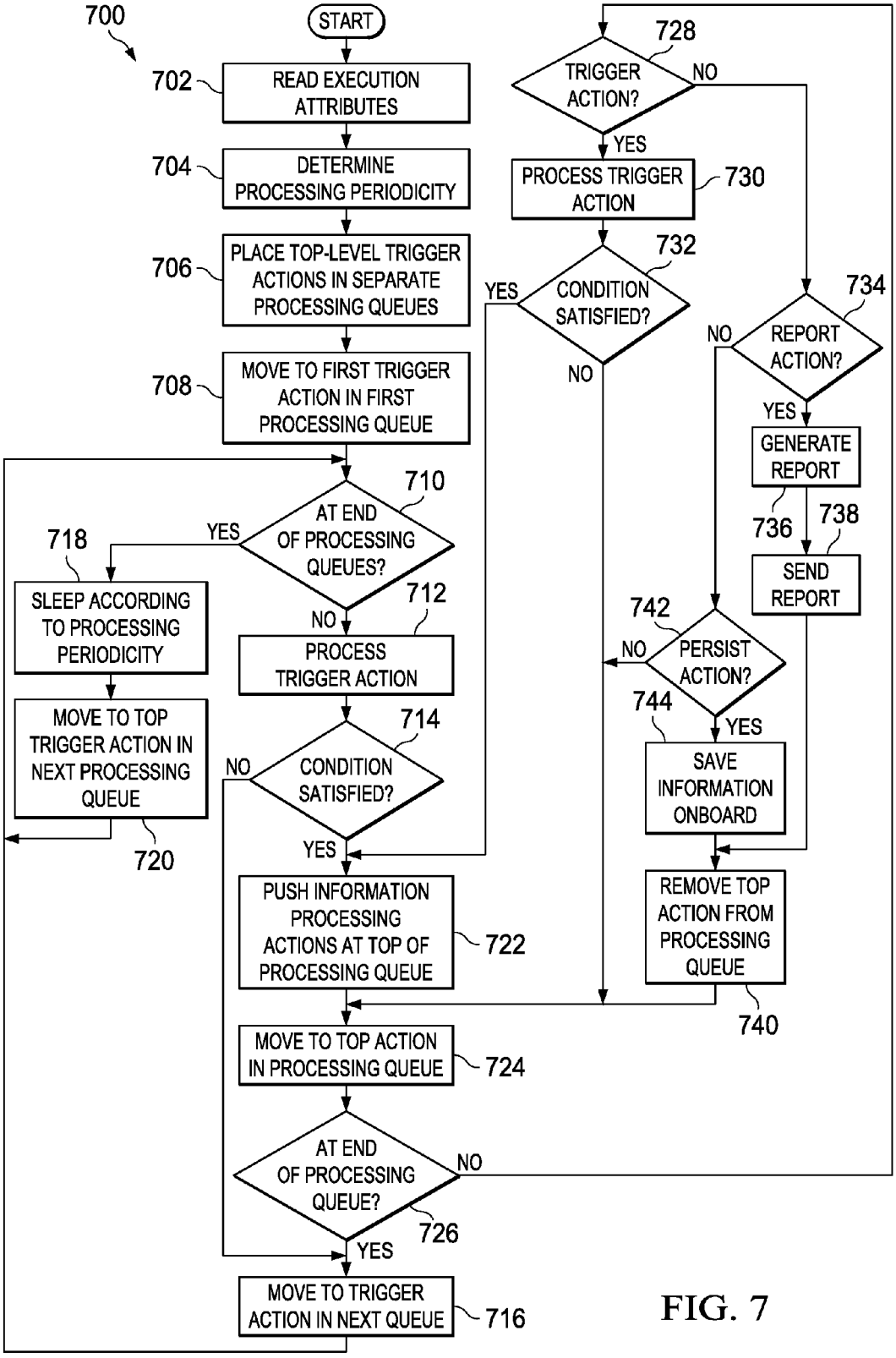
FIG. 7 is an illustration of a flowchart of a process for onboard information processing in accordance with an illustrative embodiment.

Turning to FIG. 7, an illustration of a flowchart of a process for onboard information processing is depicted in accordance with an illustrative embodiment. Process 700 may be an example of one implementation of a process for performing operation 606 in process 600 in FIG. 6. Process 700 may be implemented, for example, in computer program 108 running on data processing system 106 on aircraft 102 in FIG. 1.

Process 700 may begin by reading execution attributes (operation 702). The execution attributes may define a number of information processing actions, including top-level trigger actions and other information processing actions associated with the top-level trigger actions. Processing periodicity then may be determined (operation 704). Processing periodicity may determine how often trigger actions will be processed to determine whether conditions for the trigger actions have been satisfied. For example, without limitation, processing periodicity determined in operation 704 may be identified in a file or document that also includes the execution attributes read in operation 702.

Top-level trigger actions defined by the execution attributes read in operation 702 may be placed in separate processing queues (operation 706). Process 700 then may move to consider the first trigger action in the first of the processing queues (operation 708).

It may be determined whether the end of the processing queues has been reached (operation 710). If the end of the processing queues has not been reached, the current trigger action under consideration may be processed (operation 712) to determine whether the condition for the trigger action is satisfied (operation 714). If the condition for the trigger action is not satisfied, process 700 may move to a trigger action in the next processing queue (operation 716) and then return to operation 710 to determine whether the end of the processing queues has been reached.

In response to a determination at operation 710 that the end of the processing queues has been reached, process 700 may sleep for a period of time according to the processing periodicity determined in operation 704 (operation 718). Process 700 then may move to consider the top trigger action in the next processing queue (operation 720) and return to operation 710 to determine whether the end of the processing queues has been reached.

Returning to operation 714, in response to a determination that the condition for the trigger action is satisfied, the information processing actions associated with the trigger action may be pushed at the top of the processing queue (operation 722). Process 700 may then move to consider the top action in the processing queue (operation 724).

It may be determined whether the end of the processing queue has been reached (operation 726). If the end of the processing queue has been reached, process 700 may return to operation 716 where process 700 may move to consider a trigger action in the next processing queue.

When it is determined at operation 726 that the end of the processing queue has not been reached, it may be determined whether the information processing action under consideration is a trigger action (operation 728). If the action is a trigger action, in this case, the trigger action is a sub-level trigger action. The trigger action may be processed (operation 730) to determine whether the condition for the trigger action is satisfied (operation 732). If the condition for the trigger action is satisfied, process 700 may return to operation 722 where the information processing actions associated with the trigger action may be pushed at the top of the processing queue. If it is determined at operation 732 that the condition for the trigger action is not satisfied, process 700 may return to operation 724.

Returning to operation 728, when it is determined that the information processing action under consideration is not a trigger action, it may be determined whether the information processing action under consideration is a report action (operation 734). If the action is a report action, a report may be generated (operation 736) and the report may be sent (operation 738). The current top action then may be removed from the processing queue (operation 740) and process 700 may return to operation 724 where process 700 moves to consider the new top action in the processing queue.

Returning to operation 734, when it is determined that the information processing action under consideration is not a report action, it may be determined whether the information processing action is a persist action (operation 742). If the action is a persist action, information may be saved onboard the aircraft or other vehicle on which process 700 is running. Process 700 may then proceed to operation 740, where the current top action is removed from the processing queue. In response to a determination at operation 734 that the information processing action under consideration is not a persist action, process 700 may return to operation 724.

Process 700 may run continuously over a selected time period for which information processing defined by the execution attributes read in operation 702 is desired. For example, without limitation, when process 700 is run onboard an aircraft, process 700 may be started at the beginning of a flight or other operation of the aircraft and stopped at the end of the flight or other operation to provide information processing for health management of the aircraft or another appropriate purpose.

Figure 8:
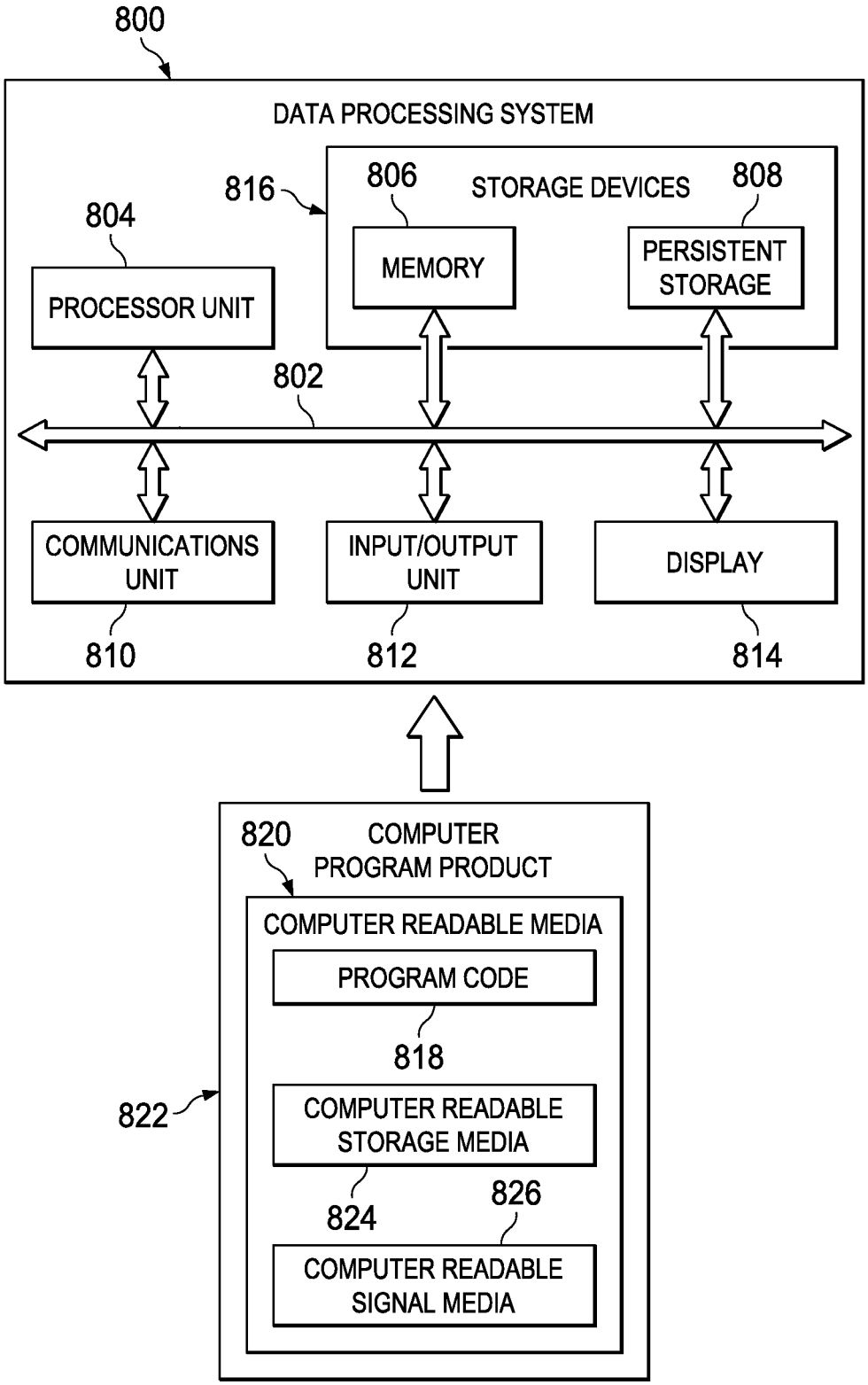
FIG. 8 is an illustration of block diagram of a data processing system in accordance with an illustrative embodiment.

Turning to FIG. 8, an illustration of a block diagram of a data processing system is depicted in accordance with an illustrative embodiment. Data processing system 800 may be an example of one implementation of data processing system 106 on aircraft 102 in FIG. 1.

In this illustrative example, data processing system 800 includes communications fabric 802. Communications fabric 802 provides communications between processor unit 804, memory 806, persistent storage 808, communications unit 810, input/output (I/O) unit 812, and display 814.

Processor unit 804 serves to execute instructions for software that may be loaded into memory 806. Processor unit 804 may be a number of processors, a multi-processor core, or some other type of processor, depending on the particular implementation. A number, as used herein with reference to an item, means one or more items. Further, processor unit 804 may be implemented using a number of heterogeneous processor systems in which a main processor is present with secondary processors on a single chip. As another illustrative example, processor unit 804 may be a symmetric multi-processor system containing multiple processors of the same type.

Memory 806 and persistent storage 808 are examples of storage devices 816. A storage device is any piece of hardware that is capable of storing information, such as, for example, without limitation, data, program code in functional form, and/or other suitable information either on a temporary basis and/or a permanent basis. Storage devices 816 may also be referred to as computer readable storage devices in these examples. Memory 806, in these examples, may be, for example, a random access memory or any other suitable volatile or non-volatile storage device. Persistent storage 808 may take various forms, depending on the particular implementation.

For example, persistent storage 808 may contain one or more components or devices. For example, persistent storage 808 may be a hard drive, a flash memory, a rewritable optical disk, a rewritable magnetic tape, or some combination of the above. The media used by persistent storage 808 also may be removable. For example, a removable hard drive may be used for persistent storage 808.

Communications unit 810, in these examples, provides for communications with other data processing systems or devices. In these examples, communications unit 810 is a network interface card. Communications unit 810 may provide communications through the use of either or both physical and wireless communications links.

Input/output unit 812 allows for input and output of data with other devices that may be connected to data processing system 800. For example, input/output unit 812 may provide a connection for user input through a keyboard, a mouse, and/or some other suitable input device. Further, input/output unit 812 may send output to a printer. Display 814 provides a mechanism to display information to a user.

Instructions for the operating system, applications, and/or programs may be located in storage devices 816, which are in communication with processor unit 804 through communications fabric 802. In these illustrative examples, the instructions are in a functional form on persistent storage 808. These instructions may be loaded into memory 806 for execution by processor unit 804. The processes of the different embodiments may be performed by processor unit 804 using computer-implemented instructions, which may be located in a memory, such as memory 806.

These instructions are referred to as program instructions, program code, computer usable program code, or computer readable program code that may be read and executed by a processor in processor unit 804. The program code in the different embodiments may be embodied on different physical or computer readable storage media, such as memory 806 or persistent storage 808.

Program code 818 is located in a functional form on computer readable media 820 that is selectively removable and may be loaded onto or transferred to data processing system 800 for execution by processor unit 804. Program code 818 and computer readable media 820 form computer program product 822 in these examples. In one example, computer readable media 820 may be computer readable storage media 824 or computer readable signal media 826.

Computer readable storage media 824 may include, for example, an optical or magnetic disk that is inserted or placed into a drive or other device that is part of persistent storage 808 for transfer onto a storage device, such as a hard drive, that is part of persistent storage 808. Computer readable storage media 824 also may take the form of a persistent storage, such as a hard drive, a thumb drive, or a flash memory, that is connected to data processing system 800. In some instances, computer readable storage media 824 may not be removable from data processing system 800.

In these examples, computer readable storage media 824 is a physical or tangible storage device used to store program code 818 rather than a medium that propagates or transmits program code 818. Computer readable storage media 824 is also referred to as a computer readable tangible storage device or a computer readable physical storage device. In other words, computer readable storage media 824 is media that can be touched by a person.

Alternatively, program code 818 may be transferred to data processing system 800 using computer readable signal media 826. Computer readable signal media 826 may be, for example, a propagated data signal containing program code 818. For example, computer readable signal media 826 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, program code 818 may be downloaded over a network to persistent storage 808 from another device or data processing system through computer readable signal media 826 for use within data processing system 800. For instance, program code stored in a computer readable storage medium in a server data processing system may be downloaded over a network from the server to data processing system 800. The data processing system providing program code 818 may be a server computer, a client computer, or some other device capable of storing and transmitting program code 818.

The different components illustrated for data processing system 800 are not meant to provide architectural limitations to the manner in which different embodiments may be implemented. The different illustrative embodiments may be implemented in a data processing system including components in addition to or in place of those illustrated for data processing system 800. Other components shown in FIG. 8 can be varied from the illustrative examples shown. The different embodiments may be implemented using any hardware device or system capable of running program code. As one example, the data processing system may include organic components integrated with inorganic components and/or may be comprised entirely of organic components excluding a human being. For example, a storage device may be comprised of an organic semiconductor.

In another illustrative example, processor unit 804 may take the form of a hardware unit that has circuits that are manufactured or configured for a particular use. This type of hardware may perform operations without needing program code to be loaded into a memory from a storage device to be configured to perform the operations.

For example, when processor unit 804 takes the form of a hardware unit, processor unit 804 may be a circuit system, an application specific integrated circuit (ASIC), a programmable logic device, or some other suitable type of hardware configured to perform a number of operations. With a programmable logic device, the device is configured to perform the number of operations. The device may be reconfigured at a later time or may be permanently configured to perform the number of operations. Examples of programmable logic devices include, for example, a programmable logic array, programmable array logic, a field programmable logic array, a field programmable gate array, and other suitable hardware devices. With this type of implementation, program code 818 may be omitted, because the processes for the different embodiments are implemented in a hardware unit.

In still another illustrative example, processor unit 804 may be implemented using a combination of processors found in computers and hardware units. Processor unit 804 may have a number of hardware units and a number of processors that are configured to run program code 818. With this depicted example, some of the processes may be implemented in the number of hardware units, while other processes may be implemented in the number of processors.

In another example, a bus system may be used to implement communications fabric 802 and may be comprised of one or more buses, such as a system bus or an input/output bus. Of course, the bus system may be implemented using any suitable type of architecture that provides for a transfer of data between different components or devices attached to the bus system.

Additionally, communications unit 810 may include a number of devices that transmit data, receive data, or transmit and receive data. Communications unit 810 may be, for example, a modem or a network adapter, two network adapters, or some combination thereof. Further, a memory may be, for example, memory 806, or a cache, such as found in an interface and memory controller hub that may be present in communications fabric 802.

The flowcharts and block diagrams in the different depicted embodiments illustrate the architecture, functionality, and operation of some possible implementations of apparatuses and methods in illustrative embodiments. In this regard, each block in the flowcharts or block diagrams may represent a module, segment, function, and/or a portion of an operation or step. For example, one or more of the blocks may be implemented as program code, in hardware, or a combination of program code and hardware. When implemented in hardware, the hardware may, for example, take the form of integrated circuits that are manufactured or configured to perform one or more operations in the flowcharts or block diagrams.

In some alternative implementations of an illustrative embodiment, the function or functions noted in the blocks may occur out of the order shown in the figures. For example, in some cases, two blocks shown in succession may be executed substantially concurrently, or the blocks may sometimes be performed in the reverse order, depending upon the functionality involved. Also, other blocks may be added in addition to the blocks illustrated in a flowchart or block diagram.

The description of the different illustrative embodiments is presented for purposes of illustration and description and is not intended to be exhaustive or to limit the embodiments in the form disclosed. Many modifications and variations will be apparent to those of ordinary skill in the art. Further, different illustrative embodiments may provide different benefits as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method of processing information onboard a vehicle, comprising:

reading, by a processor onboard the vehicle, execution attributes on the vehicle, wherein reading is performed by a computer program configured to process information about the vehicle, wherein:

the execution attributes define how the computer program processes information onboard the vehicle, and define a number of information processing actions;

the execution attributes are not part the computer program;

the execution attributes are defined in a first execution attributes file separate from the computer program;

the execution attributes comprise a number of execution stacks; and an order of the execution attributes in the execution stacks defines a sequence for processing the execution attributes;

after reading, executing, by the processor, the computer program to process information about the vehicle according to the sequence, wherein information is generated;

generating a report based on the information;

sending the report to an off-board health management system configured to monitor, collect, and analyze the report and to generate maintenance decisions; and implementing the maintenance decisions received from the off-board health management system.

2. The method of claim 1, wherein the execution attributes are processed in reverse Polish notation.

3. The method of claim 1, wherein the execution attributes comprise information identifiers identifying the information to be processed and operation identifiers identifying operations to be performed on the information.

4. The method of claim 3, wherein the information identifiers identify information sources for the information.

5. The method of claim 1, wherein the number of information processing actions are selected from a trigger action, a persist action, and a report action.

6. The method of claim 1 wherein the execution attributes comprise first execution attributes, and wherein the method further comprises:

loading new execution attributes on the vehicle by loading a second execution attributes file different than the first execution attributes file, wherein the new execution attributes define a number of new information processing actions, and wherein loading the second execution attributes file does not change the computer program;

reading, by the computer program, the new execution attributes, wherein reading changes the first execution attributes; and performing the number of new information processing actions on the vehicle by the computer program using the new execution attributes, thereby changing the number of information processing actions performed by the computer program running on the data processing system on the vehicle without changing the computer program on the vehicle.

7. The method of claim 1, wherein the vehicle is an aircraft and the number of information processing actions comprises processing operational information for the aircraft while the aircraft is in flight.

8. An apparatus, comprising:

a vehicle;

a processor onboard the vehicle; and a computer readable storage media on board the vehicle and in communication with the processor, wherein the computer readable storage media stores program code, the program code configured to:

read, by the processor, execution attributes on the vehicle, wherein reading is performed by a computer program configured to process information about the vehicle, wherein:

the execution attributes define how the computer program processes information onboard the vehicle, and define a number of information processing actions;

the execution attributes are not part the computer program;

the execution attributes are defined in a first execution attributes file separate from the computer program;

the execution attributes comprise a number of execution stacks; and an order of the execution attributes in the execution stacks defines a sequence for processing the execution attributes;

after reading, execute, by the processor, the computer program to process information about the vehicle according to the sequence, wherein information is generated;

generating a report based on the information; and sending the report to an off-board health management system configured to monitor, collect, and analyze the report and to generate maintenance decisions.

9. The apparatus of claim 8, wherein the processor is configured to process the execution attributes in reverse Polish notation.

10. The apparatus of claim 8, wherein the execution attributes comprise information identifiers identifying the information to be processed and operation identifiers identifying operations to be performed on the information.

11. The apparatus of claim 10, wherein the information identifiers identify information sources for the information.

12. The apparatus of claim 8, wherein the number of information processing actions are selected from a trigger action, a persist action, and a report action.

13. The apparatus of claim 8, wherein the vehicle is an aircraft and the number of information processing actions comprises processing operational information for the aircraft while the aircraft is in flight.

14. A method of processing information onboard a platform, comprising:

loading execution attributes onto the platform, wherein:

the execution attributes define how a computer program executing onboard the platform processes information onboard the platform, and define a number of information processing actions;

the execution attributes are not part the computer program;

the execution attributes are defined in a first execution attributes file separate from the computer program;

the execution attributes comprise a number of execution stacks; and an order of the execution attributes in the execution stacks defines a sequence for processing the execution attributes;

receiving, from the platform, the report generated by the computer program;

analyzing the report to identify a desirable change to information processing onboard the platform;

generating new execution attributes to implement the desirable change to information processing onboard the platform, wherein the new execution attributes define a number of new information processing actions to be performed by the computer program without changing the computer program on the platform; and loading the new execution attributes onto the platform.

15. The method of claim 14, wherein the execution attributes are processed in reverse Polish notation.

16. The method of claim 14, wherein the execution attributes comprise information identifiers identifying information to be processed to perform the number of information processing actions and operation identifiers identifying operations to be performed on the information.

17. The method of claim 14, wherein the number of information processing actions further comprise an information processing action selected from a trigger action and a persist action.

18. The method of claim 14, wherein the platform is an aircraft and the number of information processing actions comprises processing operational information for the aircraft while the aircraft is in flight.

* * * * *